US005185595A

United States Patent [19]

Friesen

[11] Patent Number: 5,185,595

[45] Date of Patent: Feb. 9, 1993

[54] ROCKBOLT MONITOR

[76] Inventor: Gordon R. Friesen, Box 331, Balmertown, Ontario, Canada, P0V 1C0

[21] Appl. No.: 714,501

[22] Filed: Jun. 13, 1991

[30] Foreign Application Priority Data

Jun. 13, 1990 [CA] Canada ..... 2018970

[51] Int. Cl.[5] ..... C08B 21/00

[52] U.S. Cl. ..... 340/690; 73/784; 340/540; 340/665; 340/686; 340/691

[58] Field of Search ..... 340/690, 691, 665, 540, 340/686; 73/784

[56] References Cited

U.S. PATENT DOCUMENTS

| | | | |
|---|---|---|---|
| 3,111,655 | 11/1963 | Kotarsky et al. | 340/690 |
| 3,826,128 | 7/1974 | McVey et al. | 340/690 |
| 4,097,854 | 6/1978 | Black et al. | 340/690 |
| 4,136,556 | 1/1979 | Graham | 340/690 |
| 4,426,642 | 1/1984 | Doffenbarger | 340/690 |

*Primary Examiner*—Glen R. Swann, III

*Attorney, Agent, or Firm*—Murray E. Thrift; Stanley G. Ade; Adrian D. Battison

[57] ABSTRACT

A rockbolt monitor monitors increased loadings on a rockbolt in underground mines. The monitor includes a rockbolt plate fitted on the rockbolt to engage the surface of the rock, a stack of belleville washers on the end of the rockbolt outside the rockbolt plate and a spring seat plate outside the belleville washers. When a nut is fitted onto the rockbolt and torqued, the belleville washers will compress to provide the desired force urging the rockbolt plate against the surface of the rock. This spring arrangement allows relative movement of the rockbolt plate on the rockbolt in response to ground movement, such as caused by blasting. The load indicator itself includes a threaded sleeve screwed into a threaded bore in the spring seat plate. A spring loaded piston rides in the sleeve. It is biased into engagement with the rockbolt plate. The amount by which the outer end of the piston projects from the end of the sleeve is a measure of the amount of rockbolt plate movement and rockbolt loading that is taken place since installation. To provide a qualitative signal of this having occurred, the piston desirably has an outer end that is painted black and a section adjacent the outer end that is painted red. When the red portion is shown, the rockbolt plate has moved on the rockbolt. The indicator may also include a plunger to signal loosening of the rockbolt or an electric switch operable by the piston to produce an alarm signal when the rockbolt plate moves. Another embodiment of the invention involves two telescoping sleeves, one mounted on the rockbolt plate and the other on the spring seat. The outer sleeve has slots in it through which the inner sleeve movements can be observed.

20 Claims, 3 Drawing Sheets

ROCKBOLT MONITOR

FIELD OF THE INVENTION

The present invention relates to rockbolt monitoring and more particularly to a monitor for detecting changes in the tension on a rockbolt used for ground support in underground mining.

Rockbolts are used to support the roofs and walls of underground mines. A rockbolt that is subjected to an excessive load may fail, with catastrophic consequences. It is therefore important to monitor the ground conditions as they affect the rockbolt loads. Since the failure properties of rockbolts are reasonably well-known, an indication of the amount of load transferred to a rockbolt following installation can serve as an effective warning of the onset of unsafe conditions. Known rockbolt monitors proposed for this purpose suffer from certain disadvantages.

The "Ground Movement Monitor" which is a linear potentiometer mounted on the end of the rockbolt, is one known form of monitor. This is an expensive system, which limits the extent to which it is used. A less expensive monitor is a "belled" rockbolt plate. The belled plate flattens as the load increases on the rockbolt, which indicates the increased load. However, there is no way of quantifying the flattening of the plate and there is no starting reference point. It is therefore impossible to tell how much flattening occurred in initial torquing of the rockbolt and how much is due to ground movement. Other devices are subject to false activation as a result of being shaken loose by blasting vibrations.

The present invention proposes a novel rockbolt monitor.

SUMMARY

According to one aspect of the present invention there is provided a rockbolt monitor for a rockbolt anchored in rock and having an outer end projecting beyond the surface of the rock, said monitor comprising:

rockbolt plate means having an opening therethrough for receiving the outer end of the rockbolt therethrough and engageable with the surface of the rock;

spring seat means engageable with the outer end of the rockbolt;

spring means engageable between the rockbolt plate means and the spring seat means for biasing the rockbolt plate against the surface of the rock;

first load indicator means moveable with the spring seat means;

second load indicator means adjacent the first load indicator means and moveable with the rockbolt plate means; and signal means responsive to relative movement of the first and second load indicator means to produce a signal indicating that such movement has taken place.

The spring means is preferably a stack of belleville washers fitted onto the rockbolt. These are slightly conical steel washers stacked with alternate washers reversed. Springs of this sort have a substantially linear load verses deflection curve and a high load capacity. Consequently, measuring the actual change in relative position of the monitor means provide a quantitative measure of the actual ground movement. It also provides a quantitative measure of the additional loading on the rockbolt. By using springs in the system, the monitor will follow the net change in ground position, rather than showing a peak motion which may be due to shock waves from blasting.

The load indicator may be a hollow, externally threaded sleeve screwed into a hole in the spring seat, and a spring loaded piston in the sleeve. The piston rests on the rockbolt plate so that the piston displacement in the sleeve equals the ground movement with respect to the rockbolt. A second indicator may be used to show loosening of the rockbolt. This may be in form of a spring loaded plunger sliding in a cavity in the outer end of the piston. The plunger will signal movement of the piston and the rockbolt plate away from the spring seat.

An electric switch may be incorporated in the monitor to signal relative movement of the two monitoring means.

Another embodiment of the monitor has two telescoping sleeves around the stack of belleville washers and connected to the rockbolt plate and the spring seat respectively. The inner sleeve is painted red and the outer sleeve has two through slots. After installation, the complete unit is spray painted white, so that on relative movement, the red on the inner sleeve will be shown through the slot in the outer.

DETAILED DESCRIPTION

Figure 1:
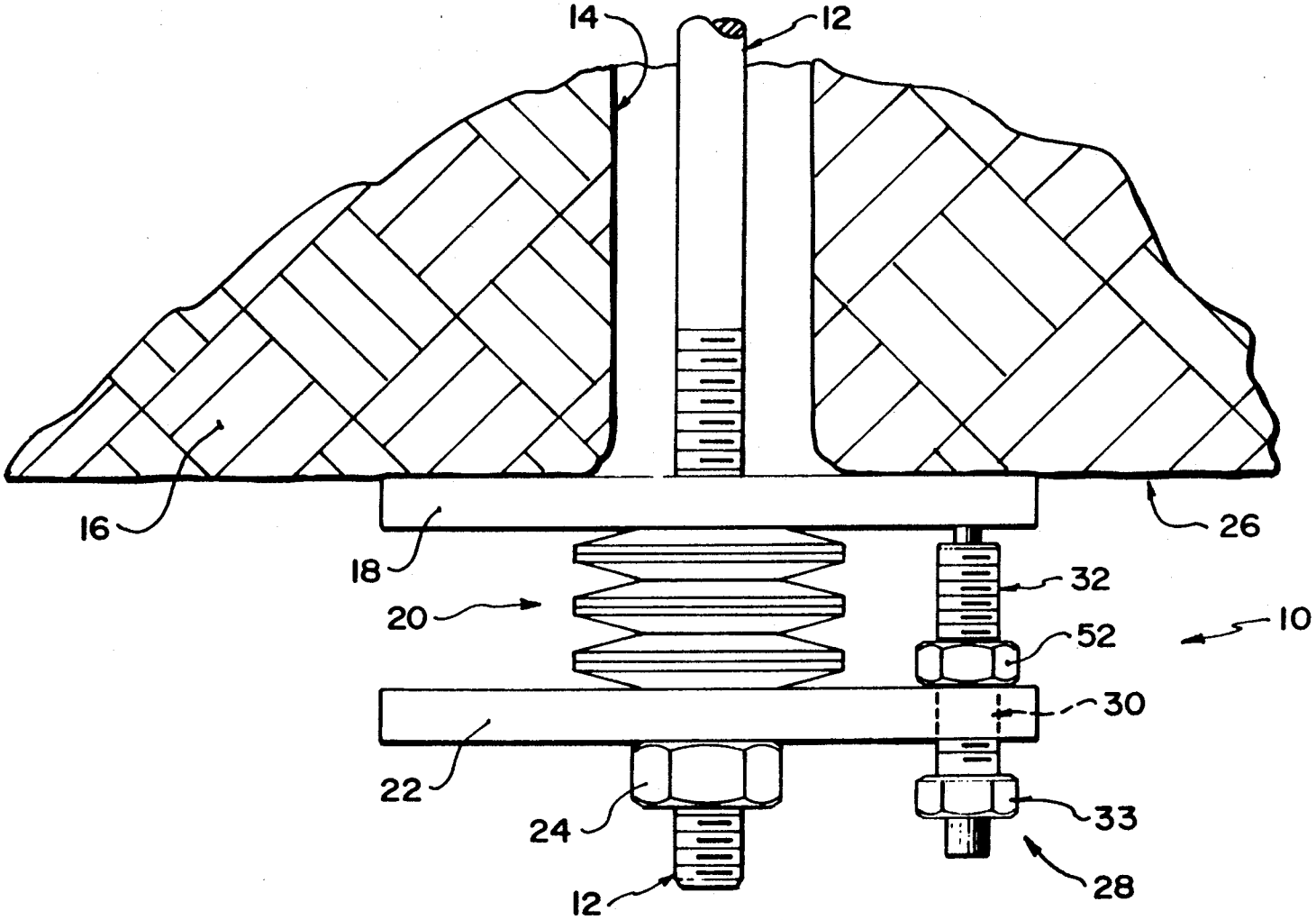
FIG. 1 is a side elevation of a monitor according to the present invention applied to a rockbolt.

Referring to the accompanying drawings, especially to FIG. 1, there is illustrated a rockbolt monitor 10 mounted on a rockbolt 12. The rockbolt is anchored at one end (not illustrated) in a bore 14 in the surrounding rock 16. A rockbolt plate 18 is fitted on the outer threaded end of the rockbolt, followed by a stack of belleville washers 20. Each belleville washer is a slightly conical steel washer that resiliently flattens under load. The spring characteristic of the belleville washers is substantially linear in the operating range. That is, its deflection is directly proportional to the load applied to it. The belleville washers also have a very high bearing capacity.

On the outer end of the rockbolt 12 is a plate 22 that serves as a spring seat for the outer end of the stack of belleville washers. This seat is secured in place on the rockbolt by a nut 24. Torquing the nut 24 will urge the spring seat 22 against the stack of belleville washers, which will in turn urge the rockbolt plate 18 against the surface 26 of the rock 16.

Figure 2:
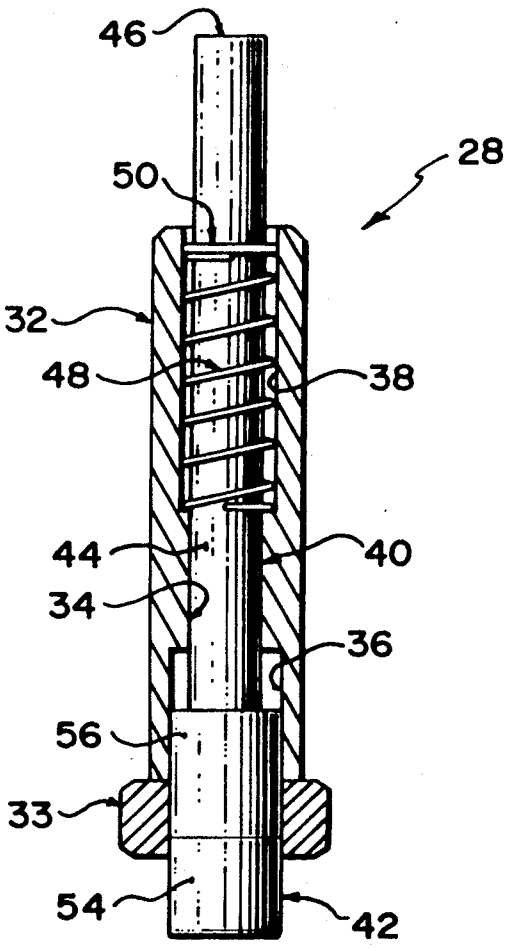
FIG. 2 is a cross section of the load indicator component of the monitor.

The spring seat plate 22 carries a load indicator 28. This is mounted in a threaded hole 30 in the spring seat plate 22. It consists of a bolt 32 with a hex head 33 at one end and an axial through bore 34 so that the bolt serves as a sleeve. The bore 34 has a counterbore 36 at one end and a counterbore 38 at the other. (FIG. 2)

A piston 40 slides in the bore 34. It has an enlarged head 42 at the head end of the bolt, sliding in counter bore 36, and a shank 44 of smaller diameter to slide in the bore 34. The length of the piston is greater than that of the bolt 32 so that it may project from both ends of the bolt. The shank has an inner end 46 that in the installed state engages the rockbolt plate 18. A coil spring 48 is accommodated in the counter bore 38 around the shank 44 and engages the end of the counter bore and a keeper 50 on the shank to bias the piston towards the rockbolt plate so that the shank end 46 remains in contact with the rockbolt plate. A lock nut 52 (FIG. 1) serves to lock the bolt in place on the plate 22.

The piston head 42 has two sections, an outer section 54 that is painted black and an inner section 56 that is painted red. When the monitor is installed on the rockbolt, the rockbolt nut 24 is torqued to the desired tension on the rockbolt and then the bolt 32 is adjusted in the hole 30 until all of the outer black section 54 of the piston head 42 projects from the end of the hole 32 and the red section is entirely covered. The lock nut 52 is used to secure the bolt in this condition. When the loading on the rockbolt increases, the rockbolt plate 18 will move towards the spring seat 22, compressing the belleville washers and pushing on the piston shank 44 so that the red section 56 of the piston head begins to project from the head of the bolt 32. The visible red of the piston head is a clear qualitative signal that loads on the rockbolt have increased. The length to which the red section 56 projects from the bolt head is a quantitative measure of the movement of the rockbolt plate 18 and the additional loading on the rockbolt 12. One particularly convenient way of determining this length is to loosen the lock nut 52 and to turn the bolt 32 out until the end of the bolt head is flush with the junction between the red section 56 and black section 54 of the piston head. Knowing the pitch of the bolt threads and the number of turns necessary to reach this condition allows a direct computation of the dimension in question.

Figure 4:
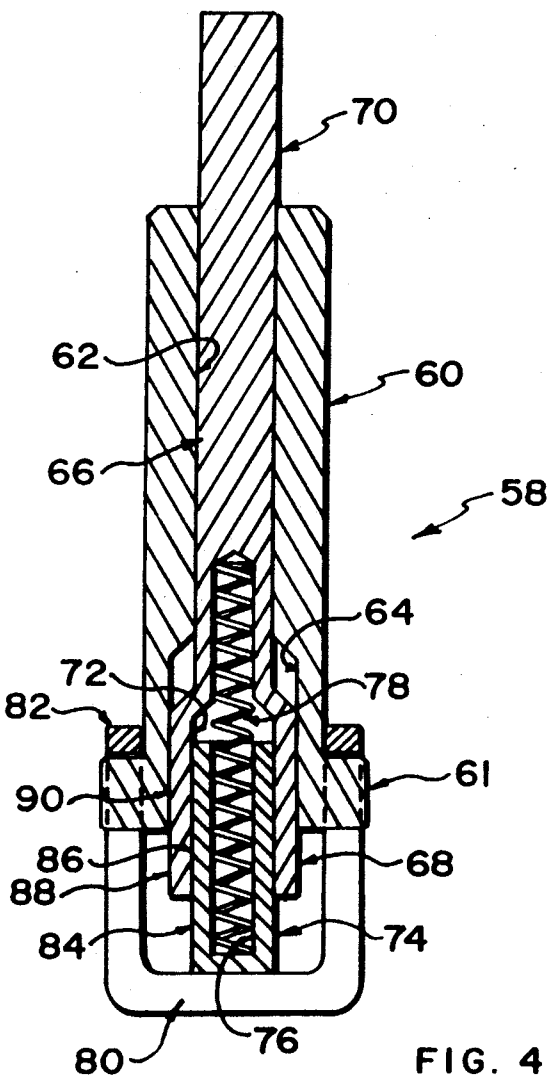
FIG. 4 is a cross section of an alternative embodiment of the load indicator.

A second embodiment of the load indicator is illustrated is FIG. 4. In this embodiment, the indicator 58 includes a threaded outer sleeve in the form of bolt 60 with a head 61 and a centre bore 62. The bore 62 has a counter bore 64 at the outer end. A piston 66 slides in the bore 62 with its enlarged head 68 fitting into the counter bore 64. The shank 70 of the piston projects from the inner end of the bolt. At the head end of the piston is a cavity 72 in the form of a bore accommodating a plunger 74. The plunger has a cavity 76 in its inner end, accommodating the end of a light spring 78 extending to the base of the cavity 72 in the piston. The movement of the plunger is limited by a retaining clip 80 extending over the end of the plunger and fastened to the head of the bolt 60 by a hook.

Figure 3:
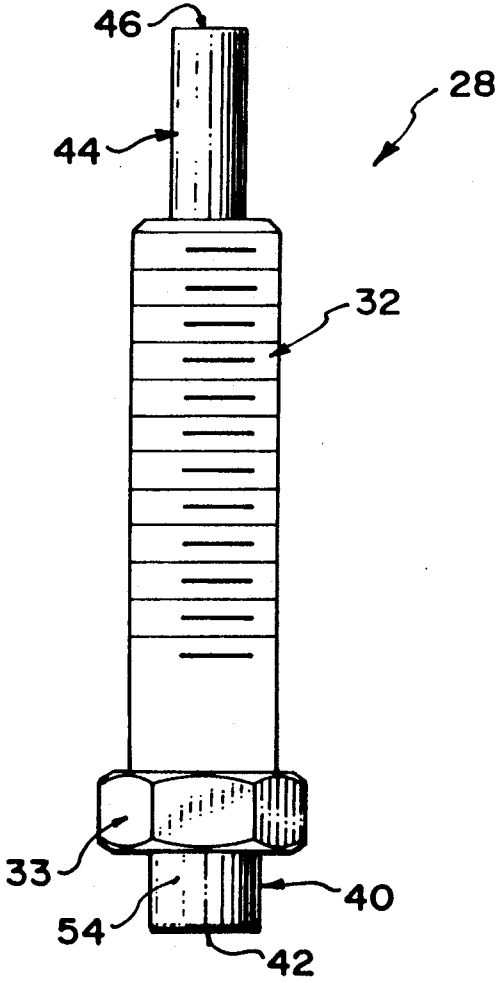
FIG. 3 is an elevation of the load indicator component of the monitor.

The plunger 74 has an outer part 84 that is black in color and an inner part 86 that is red in color. Similarly, the piston head 68 has a black outer part 88 and a red inner part 90. When this indicator is mounted on the spring seat plate 22, it is brought to an initial condition with the black part of the piston projecting from the head of the bolt and covering the red part of the plunger. If the rockbolt is loosened and the rockbolt plate and the spring seat are spread apart, the piston will extend further from the inner end of the bolt and movement of the piston head will expose the red inner part 86 of the plunger. The red part of the piston head is exposed in the same way as the red part of the piston head in the embodiment illustrated in FIGS. 1, 2 and 3.

Figure 5:
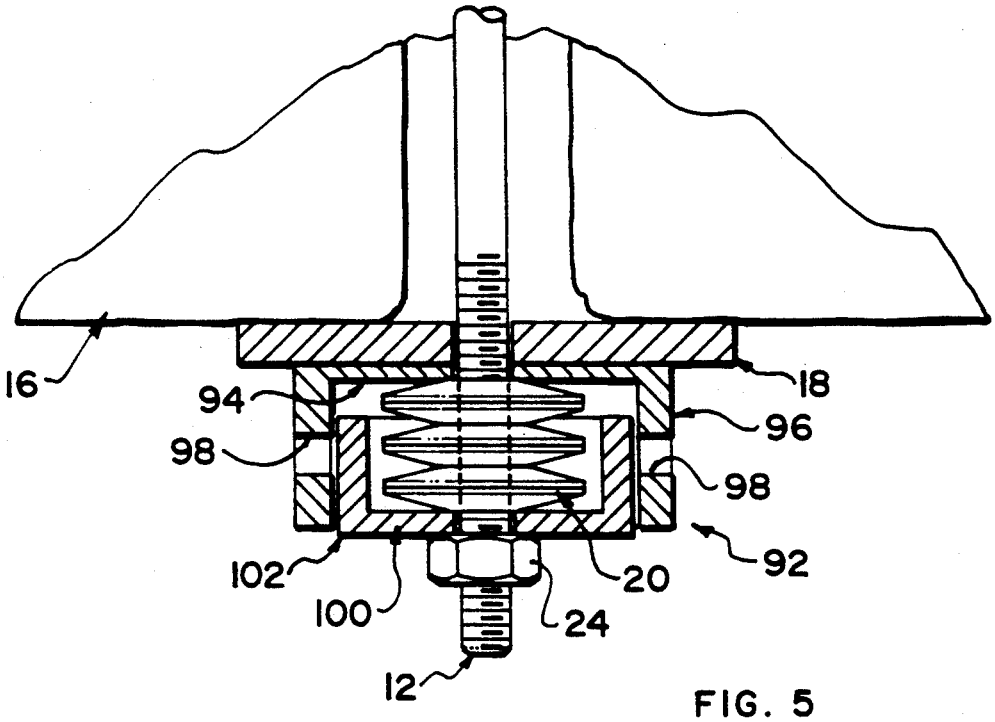
FIG. 5 is a side view, partially in section of a further embodiment of the monitor.

Another embodiment of the monitor is illustrated in FIG. 5. The monitor 92 includes a plate 94 that fits onto the rockbolt just outside the rockbolt plate 18. It carries an outer sleeve 96 with two circumferentially extending slots 98. The belleville washers are retained on the rockbolt by an end plate 100 and nut 24. The end plate carries an inner sleeve 102 that is telescopically fitted into the outer sleeve 96. The two sleeves surround the belleville washers.

Before the monitor is installed, the inner sleeve 102 is painted red. After installation, the load indicator sleeves are spray painted white. When there is any movement of the rockbolt with respect to the rockbolt plate, there is relative movement of the inner and outer sleeves and the red portions of the inner sleeve will become visible through the slots 98.

Figure 6:
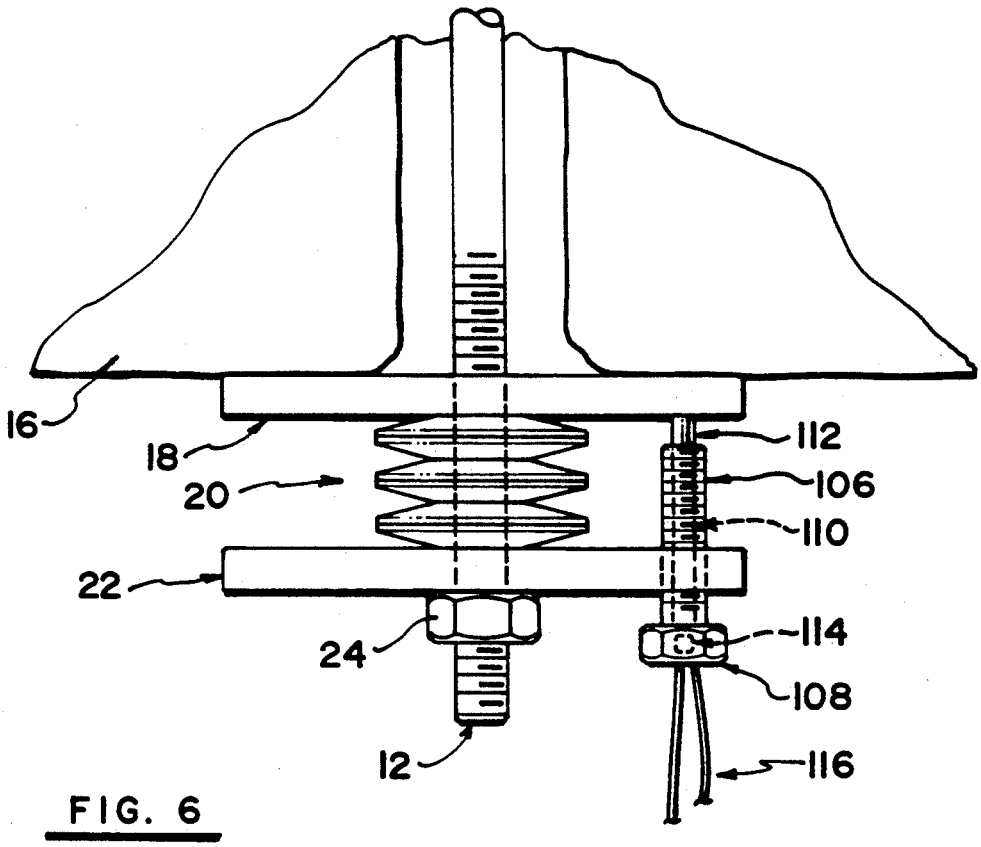
FIG. 6 is a side view of a further embodiment of the load indicator.

A fourth embodiment of the load indicator is illustrated in FIG. 6. In that embodiment, the indicator includes a sleeve in the form of bolt 106 with a head 108 and a through bore 110 carrying a spring loaded piston 112. These components act much in the same way as previously described. In this case however, there is an electric switch 114 in the head of the bolt 106 for actuation by the piston as the piston moves outwardly in the bore 110 in response to movement of the rockbolt plate towards the spring seat. Two LEADs 116 complete a circuit to a warning flasher (not shown).

While particular embodiments of the present invention have been described in the foregoing, it is to be understood that other embodiments are possible within the scope of the invention. The invention is to be considered limited solely by the scope of the appended claims.

I claim:

1. A rockbolt monitor for a rockbolt anchored in rock and having an outer end projecting beyond the surface of the rock, said monitor comprising:

rockbolt plate means having an opening therethrough for receiving the outer end of the rockbolt therethrough and engageable with the surface of the rock;

spring seat means engageable with the outer end of the rockbolt;

spring means engageable between the rockbolt plate means and the spring seat means for biasing the rockbolt plate against the surface of the rock;

first load indicator means moveable with the spring seat means;

second load indicator means adjacent the first load indicator means and moveable with the rockbolt plate means; and signal means responsive to relative movement of the first and second load indicator means to produce a signal indicating that such movement has taken place.

2. A monitor according to claim 1 wherein the spring means comprise substantially linear springs.

3. A monitor according to claim 1 wherein the spring means comprise a stack of belleville washers surrounding the rockbolt.

4. A monitor according to claim 1 wherein one of the first and second load indicator means comprises a sleeve and the other of the first and second load indicator means comprises a member slideable in the sleeve.

5. A monitor according to claim 4 wherein the signal means comprises a visual indicator on the member slideable in the sleeve, the indicator being normally located within the sleeve and being displaced from the sleeve in response to relative movement of the member in the sleeve.

6. A monitor according to claim 4 including mounting means mounting the sleeve on the spring seat, substantially perpendicular to the rockbolt plate.

7. A monitor according to claim 6 wherein the mounting means comprise means adjustably mounting the sleeve on the spring seat for selective movement towards and away from the rockbolt plate.

8. A monitor according to claim 6 wherein the mounting means comprise a threaded hole in the spring seat, and an external thread on the sleeve, mating with the threaded hole.

9. A monitor according to claim 6 further comprising a resilient means urging the member slideable in the sleeve to move out of the sleeve into engagement with the rockbolt plate.

10. A monitor according to claim 1 wherein the signal means comprises an electrical switch, operable in response to relative movement of the first and second load indicator means.

11. A rockbolt monitor for a rockbolt anchored in rock and having an outer end projecting beyond the surface of the rock, said monitor comprising:

a rockbolt plate having an opening therethrough engageable over the outer end of the rockbolt;

spring seat means engageable on the outer end of the rockbolt, and having a threaded hole therein substantially perpendicular to the rockbolt plate;

spring means engageable between the rockbolt plate and the spring seat means for urging the rockbolt plate against the surface of the rock;

a threaded sleeve screwed into the threaded hole in the spring seat means;

piston means slideable in the sleeve;

resilient means for urging the piston means out the sleeve for engaging an inner end of the piston with the rockbolt plate; and signal means responsive to movement of the piston means in the sleeve to produce a signal indicating the occurrence of such movement.

12. A monitor according to claim 11 wherein the piston means has a length greater than the length of the sleeve and the signal means comprise first indicator means carried by the piston adjacent the outer end thereof.

13. A monitor according to claim 12 further comprising a cavity in the outer end of the piston, a plunger slideable in the cavity, means urging the plunger out of the cavity, retaining means for holding the plunger on the sleeve, and second indicator means carried by the plunger, the second indicator means being visible when the plunger projects from the piston more than a predetermined amount.

14. A monitor according to claim 13 wherein the resilient means comprise a spring in the cavity urging the piston and plunger away from one another.

15. A monitor according to claim 11 wherein the spring means comprise substantially linear springs.

16. A monitor according to claim 11 wherein the spring means comprise a stack of belleville washers surrounding the rockbolt.

17. A rockbolt monitor for a rockbolt anchored in rock and having an outer end projecting beyond the surface of the rock, said monitor comprising:

a rockbolt plate having an opening therethrough for engagement over the outer end of the rockbolt and for engagement with the surface of the rock;

spring seat means for mounting on the outer end of the rockbolt;

spring means engageable between the rockbolt plate and the spring seat means for urging the rockbolt plate against the surface of the rock;

telescopically engageable inner and outer load indicator sleeves, one of the sleeves being carried by the rockbolt plate and the other of the sleeves being carried by the spring seat; and at least one indicator opening in the outer load indicator sleeve.

18. A monitor according to claim 17 wherein the outer sleeve is carried by the rockbolt plate and the inner sleeve is carried by the spring seat.

19. A monitor according to claim 18 wherein the at least one indicator opening comprises one or more slots.

20. A monitor according to claim 17 wherein the spring means comprise a stack of belleville washers within the inner monitor sleeve.

* * * * *